US006712350B2

(12) United States Patent
Tokuda

(10) Patent No.: US 6,712,350 B2
(45) Date of Patent: Mar. 30, 2004

(54) SHEET FEEDING APPARATUS AND IMAGE FORMING APPARATUS

(75) Inventor: Tetsuo Tokuda, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 10/060,770

(22) Filed: Feb. 1, 2002

(65) Prior Publication Data

US 2002/0113360 A1 Aug. 22, 2002

(30) Foreign Application Priority Data

Feb. 6, 2001 (JP) ..... 2001-030007
Jan. 31, 2002 (JP) ..... 2002-023917

(51) Int. Cl.[7] ..... B65H 3/52
(52) U.S. Cl. ..... 271/109
(58) Field of Search ..... 271/109, 121, 271/104, 137; 400/167, 629; B65H 3/06, 3/52, 3/43, 3/34

(56) References Cited

U.S. PATENT DOCUMENTS 5,326,091 A * 7/1994 Giacometto et al. ..... 271/10.01

FOREIGN PATENT DOCUMENTS

JP 2001-39566 * 2/2001 ..... B65H/3/52
JP 2001-151367 * 6/2001 ..... B65H/3/52
JP 2003-112837 * 4/2003 ..... B65H/3/52

* cited by examiner

*Primary Examiner*—Donald P. Walsh
*Assistant Examiner*—Kenneth W. Bower
(74) *Attorney, Agent, or Firm*—Fitzpatrick, Cella, Harper & Scinto

(57) ABSTRACT

A sheet feeding apparatus provided with a sheet feeding rotary member rotatable in a direction for feeding sheets, and a separating pad biased toward the sheet feeding rotary member, and for separating the sheets one by one between the sheet feeding rotary member and the separating pad and feeding them has a vibration absorbing member interposed between the separating pad and a pad supporting portion for pivotally supporting the separating pad for absorbing the vibration of the separating pad.

11 Claims, 8 Drawing Sheets

SHEET FEEDING APPARATUS AND IMAGE FORMING APPARATUS

BACKGROUND OF THE INVENTION

1. Field of the Invention

The invention relates to a sheet feeding apparatus for separating and feeding sheets such as stacked originals and recording mediums one by one, and an image forming apparatus provided with the sheet feeding apparatus.

2. Description of Related Art

There are known an image forming apparatus of the ink jet type for discharging ink to a recording medium such as recording paper to thereby form an image thereon, and an image forming apparatus of the electrophotographic type for forming an image on a recording medium by the use of a developer (toner), and these image forming apparatuses are provided with a sheet feeding apparatus for supplying the recording medium to an image forming portion.

Now, in some printers, as a sheet feeding apparatus for supplying a recording medium (hereinafter referred to as the sheet) to image forming means, provision is made of a multisheet feeding apparatus of a construction in which sheets set on a tray by a user are fed out, besides a sheet feeding apparatus of a construction in which sheets are fed out from a sheet feeding cassette containing the sheets therein. The multisheet feeding apparatus can set and feed sheets of various sizes and sheets of various kinds, and is efficient for the feeding of a small quantity of sheets, and the feeding of spatial paper such as thick paper or film paper.

An example of the conventional multisheet feeding apparatus will hereinafter be described with reference to FIGS. 6 to 8 of the accompanying drawings. FIG. 6 is a longitudinal cross-sectional view of the multisheet feeding apparatus, FIG. 7 is a perspective view of a separating pad, and FIG. 8 is an enlarged view showing a state in which a sheet is being separated by a sheet feeding roller and the separating pad.

The multisheet feeding apparatus 50 is provided with an intermediate plate 54 on which a plurality of sheets P are stacked, a side regulating plate 82 for regulating the widthwise position of the sheets P stacked on the intermediate plate 54, and an intermediate plate spring 56 for upwardly biasing the leading edge side end portion of the intermediate plate 54 in the sheet feeding direction. Above the intermediate plate spring 56, there is disposed a sheet feeding roller 58 for contacting with the sheets P stacked on the intermediate plate 54 to thereby feed out the sheets P one by one in the sheet feeding direction (the direction indicated by the arrow C).

Downstream of the sheet feeding roller 58 in the sheet feeding direction, there is disposed a sheet feeding guide 60 for guiding the sheet P fed out by the sheet feeding roller 58 to a pair of registration rollers 38 disposed on the downstream side in the sheet feeding direction. A pair of U-shaped grooves 62 (shown in FIG. 8) are formed at the right and left of the sheet feeding guide 60 as viewed in a direction orthogonal to the sheet feeding direction on the upstream side in the sheet feeding direction, and the opening 62*a* of each groove 62 faces downwardly.

A separating pad 70 is disposed adjacent to and upstream of the sheet feeding guide 60 in the sheet feeding direction. The separating pad 70 is comprised of a plate-shaped separating pad holder 70*a* provided with two pivot shafts 72 orthogonal to the sheet feeding direction on the downstream side in the sheet feeding direction, and a rectangular separating pad member 74 stuck on the upstream side surface of the separating pad holder 70*a* in the sheet feeding direction and formed of urethane rubber containing cork or the like. The two pivot shafts 72 of the separating pad holder 70*a* fit into the grooves 62, whereby the separating pad 70 is supported for pivotal movement.

Below the separating pad holder 70*a,* there is disposed a separating spring 76 comprising a coil spring for upwardly biasing the separating pad holder 70*a.* Since the separating spring 76 pushes up that portion of the separating pad holder 70*a* which is opposite to the pivot shaft 72 from below it, the separating pad holder 70*a* is pivotally moved about the pivot shaft 72. As the result, the separating pad member 74 is urged against the sheet feeding roller 58. Accordingly, the sheet feeding roller 58 is rotated in the direction indicated by the arrow D, whereby the stacked sheet is fed out from the intermediate plate 54, and when two or more sheets are fed out, they are separated one by one between the separating pad member 74 and the sheet feeding roller 58.

Now, to feed the sheet P smoothly in the sheet feeding direction, it is necessary that the surface of the separating pad member 74 be urged against the outer peripheral surface of the sheet feeding roller 58 with uniform contact pressure, and if the contact pressure is non-uniform, the sheet P may not be fed smoothly. When for example, greater contact pressure acts on one of the portions of the separating pad member 74 in the left to right direction thereof (the direction orthogonal to the direction indicated by the arrow C) than on the other portion, the sheet P being separated may be skew-fed or the sheet P may not be separated but may be jammed near the separating pad member 74.

In order that as described above, the surface of the separating pad member 74 may be urged against the outer peripheral surface of the sheet feeding roller 58 with uniform contact pressure, it is necessary that the line of contact 74*a* (shown in FIG. 7) when the separating pad member 74 contacts with the sheet feeding roller 58 and the center line of pivotal movement 72*a* (shown in FIG. 7) of the pivot shafts 72 of the separating pad holder 70*a* be parallel to each other. However, the accuracy of the position at which the sheet feeding guide 60 is fixed to the main body of the printer 10 or the accuracy of the shape thereof is sometimes bad due to the deformation or the like of the separating pad holder 70*a* and therefore, the line of contact 74*a* and the center line of pivotal movement 72*a* sometimes do not become parallel to each other.

Accordingly, when the pivot shafts 72 are fitted into the grooves 62 without any gap to such a degree that the pivot shafts 72 can freely pivotally move in the grooves 62, it is difficult due to the above-mentioned accuracy for the line of contact 74*a* and the center line of pivotal movement 72*a* to become parallel to each other. So, the grooves 62 are formed relatively larger than the outer diameter of the pivot shafts 72 so that irrespective of the above-mentioned accuracy, the line of contact 74*a* and the center line of pivotal movement 72*a* may become parallel to each other. By so constructing, the surface of the separating pad member 74 is urged against the outer peripheral surface of the sheet feeding roller 58 with uniform contact pressure.

Now, the coefficient of friction of the sheet feeding roller 58 and the coefficient of friction of the separating pad member 74 with respect to the sheet P differ from each other. Also, as described above, the grooves 62 are larger than the outer diameter of the pivot shafts 72 and therefore, there is more or less play or slop between these two. Therefore, when the sheet P nipped by and between the separating pad member 74 and the sheet feeding roller 58 is fed, the sheet P and the separating pad member 74 may rub against each other to thereby cause stick-slip motion. Due to the stick-slip motion, there occurs vibration and occurs an abnormal sound called pad chatter (squeak).

So, as techniques for preventing the pad chatter, the following techniques (1) to (4) are under consideration:

(1) The technique of disposing a member for contacting with the front side or the backside of the sheet P on the downstream side of the position, in which the sheet feeding roller 58 and the separating pad member 74 nip the sheet P therebetween, in the sheet feeding direction, and stopping the vibration of the sheet P;

(2) The technique of weakening the force with which the separating pad member 74 urges the sheet feeding roller 58 and preventing the stick-slip motion to thereby prevent the pad chatter;

(3) The technique of contriving the weight and shape of the separating pad holder 70*a* to change the resonance point of the separating pad holder 70*a* and decrease the vibration of the separating pad holder 70*a;* and (4) The technique of fitting the pivot shafts 72 into the grooves 62 without any gap to thereby prevent the vibration of the separating pad holder 70*a*.

However, according to the technique (1), the vibration of the sheet P can be stopped, but the vibration of the separating pad holder 70*a* cannot be stopped and therefore, the pad chatter cannot be completely prevented.

According to the technique (2), the possibility of the separation of the sheet P becoming incomplete is great and therefore, the sheets P may be double-fed, and the sheet feeding performance is reduced.

According to the technique (3), the vibration of the separating pad holder 70*a* can be mitigated, but depending on the thickness, density and stiffness of the sheet P, the pad chatter occurs and cannot be sufficiently coped with.

According to the technique (4), the contact pressure with which the separating pad member 74 contacts with the sheet feeding roller 58 becomes non-uniform, and the sheet P is not fed smoothly and skew feed or jam or the like is liable to occur and the sheet feeding performance may be reduced.

SUMMARY OF THE INVENTION

In view of the above-noted circumstances, the present invention has as its object to provide a sheet feeding apparatus in which pad chatter is prevented without the sheet feeding performance being reduced.

The sheet feeding apparatus of the prevent invention for achieving the above object is a sheet feeding apparatus provided with a sheet feeding rotary member rotatable in a direction for feeding sheets, and a separating pad biased toward the sheet feeding rotary member, and for separating the sheets one by one between the sheet feeding rotary member and the separating pad and feeding the sheets, wherein a vibration absorbing member for absorbing the vibration of the separating pad is interposed between the separating pad and a pad supporting portion for pivotally supporting the separating pad.

Also, the sheet feeding apparatus of the present invention is provided with a sheet feeding rotary member rotatable in a direction for feeding sheets, and a separating pad biased toward the sheet feeding rotary member, and for separating the sheets one by one between the sheet feeding rotary member and the separating pad and feeding the sheets, wherein the space between the separating pad and a pad supporting portion for pivotally supporting the separating pad is filled with an elastic adhesive.

DESCRIPTION OF THE PREFERRED EMBODIMENTS

Figure 1:
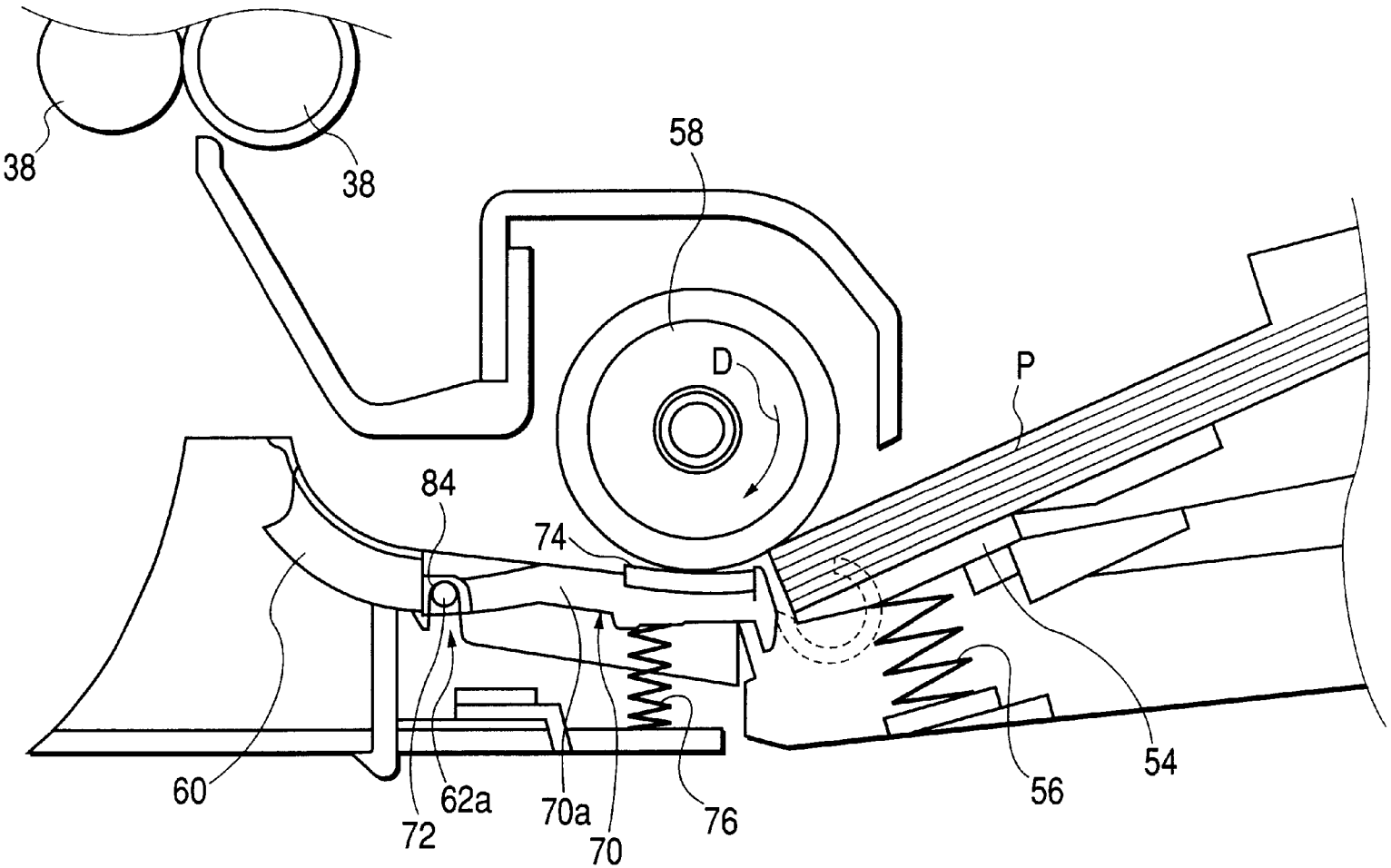
FIG. 1 is a longitudinal cross-sectional view showing the essential portions of a first embodiment of the sheet feeding apparatus of the present invention.
Figure 2:
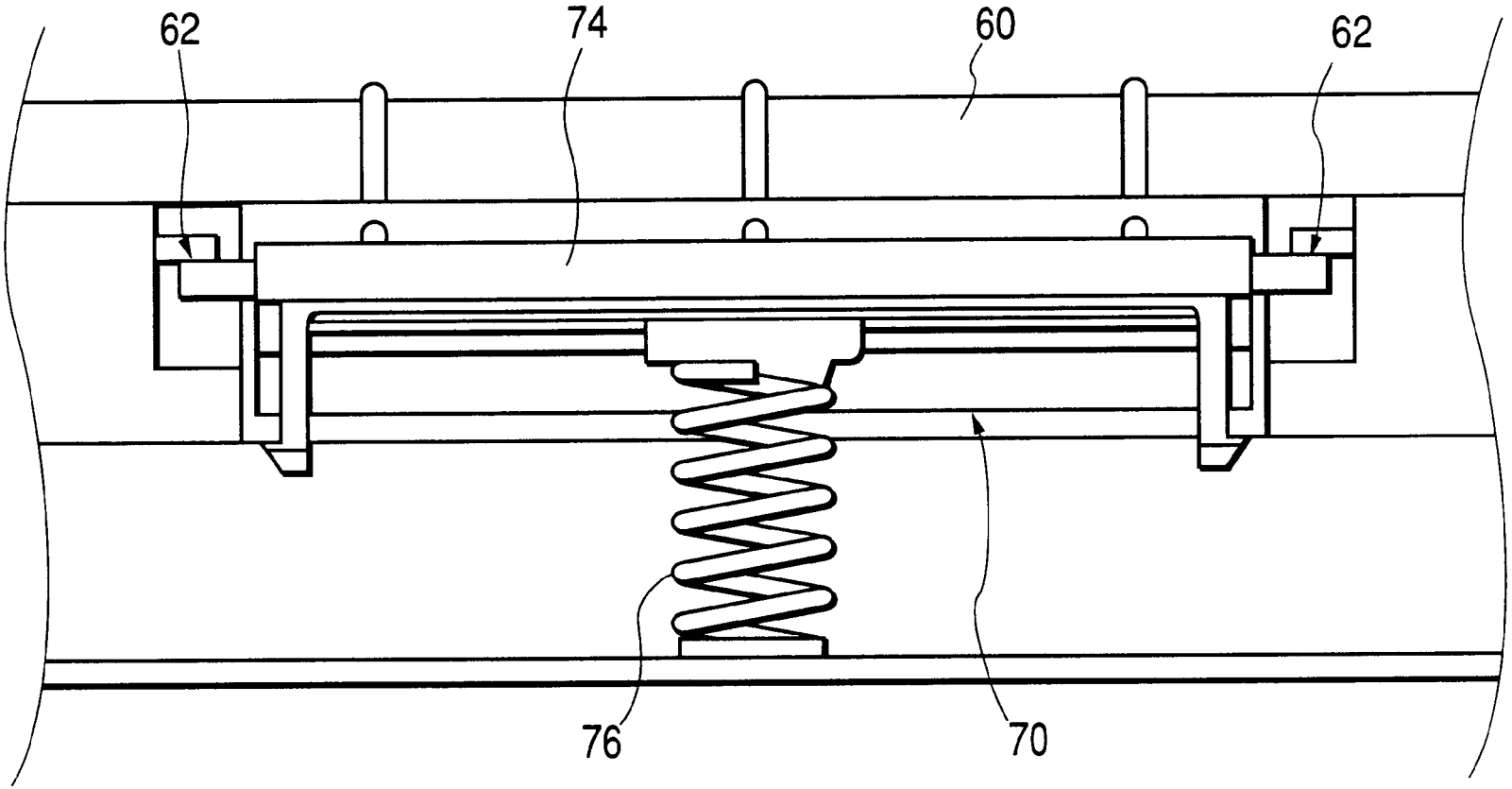
FIG. 2 is a front view of the sheet feeding apparatus of FIG. 1 as viewed in the sheet feeding direction.
Figure 3B:
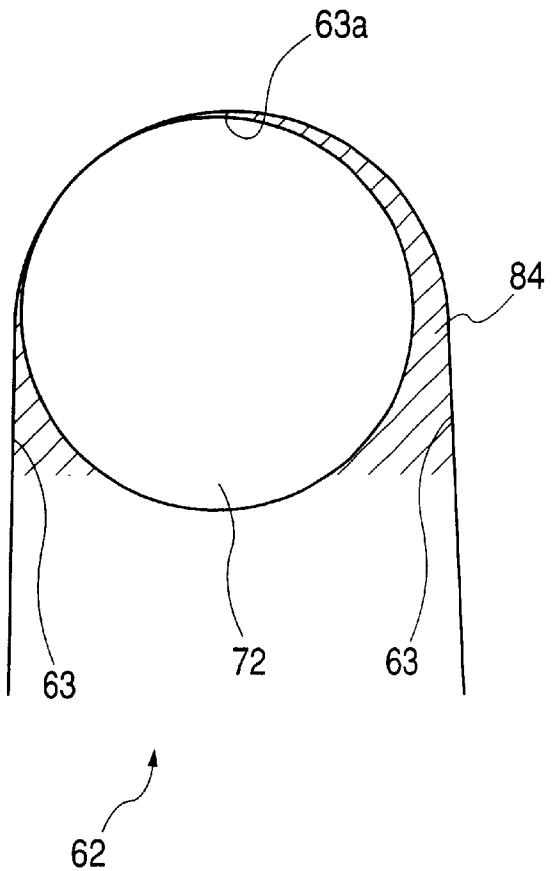
FIGS. 3A and 3B are enlarged views showing a pivot shaft fitted in a groove.
Figure 3A:
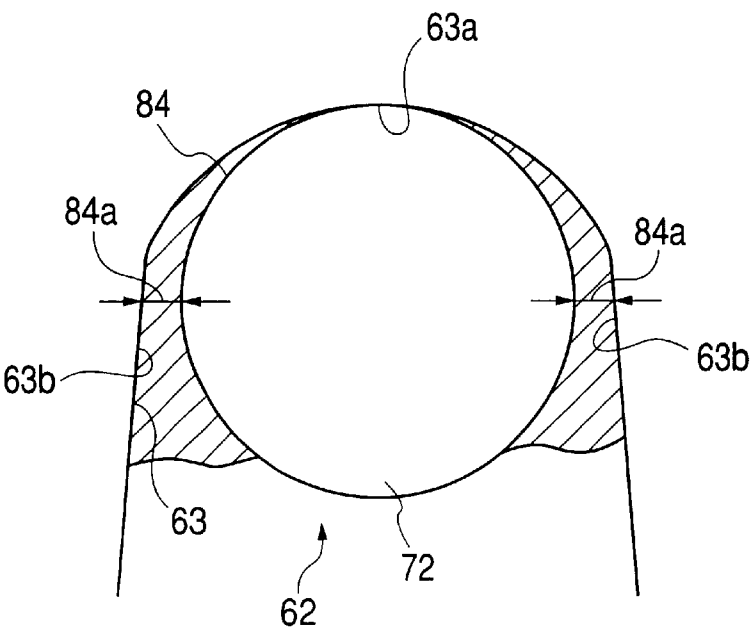
Figure 4:
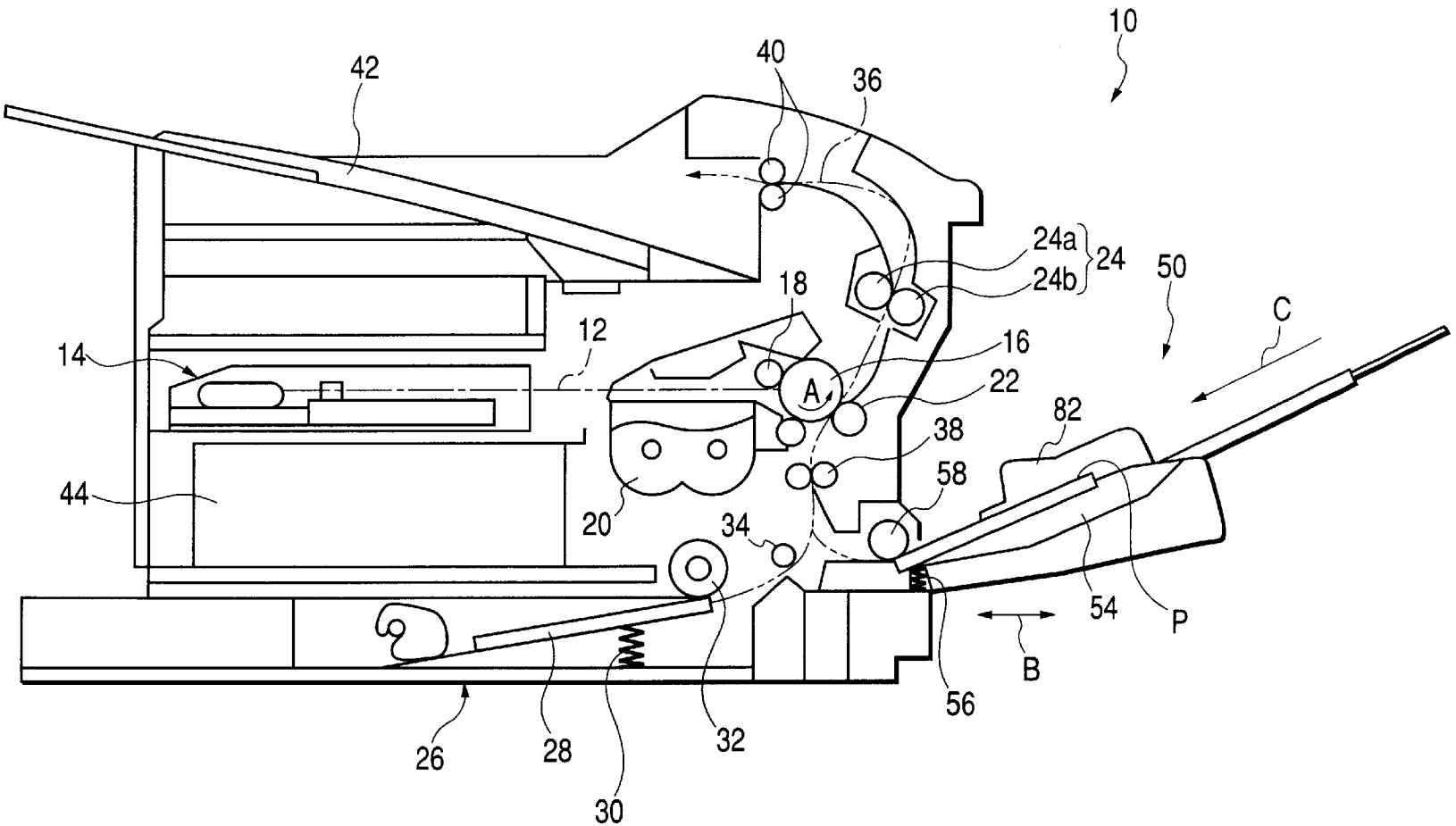
FIG. 4 is a longitudinal cross-sectional view showing an example of an image forming apparatus provided with the sheet feeding apparatus of the present invention.
Figure 6:
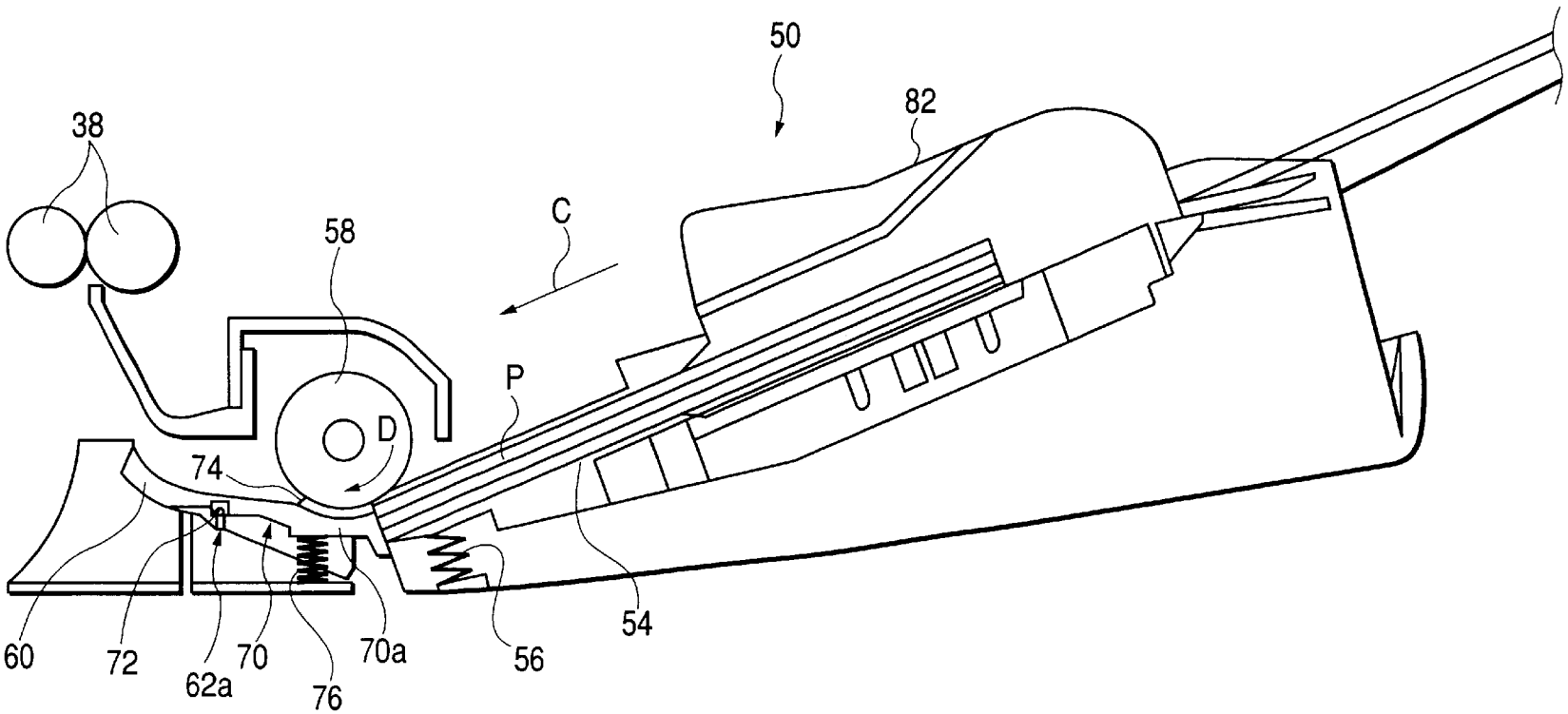
FIG. 6 is a longitudinal cross-sectional view showing an example of a conventional sheet feeding apparatus.
Figure 7:
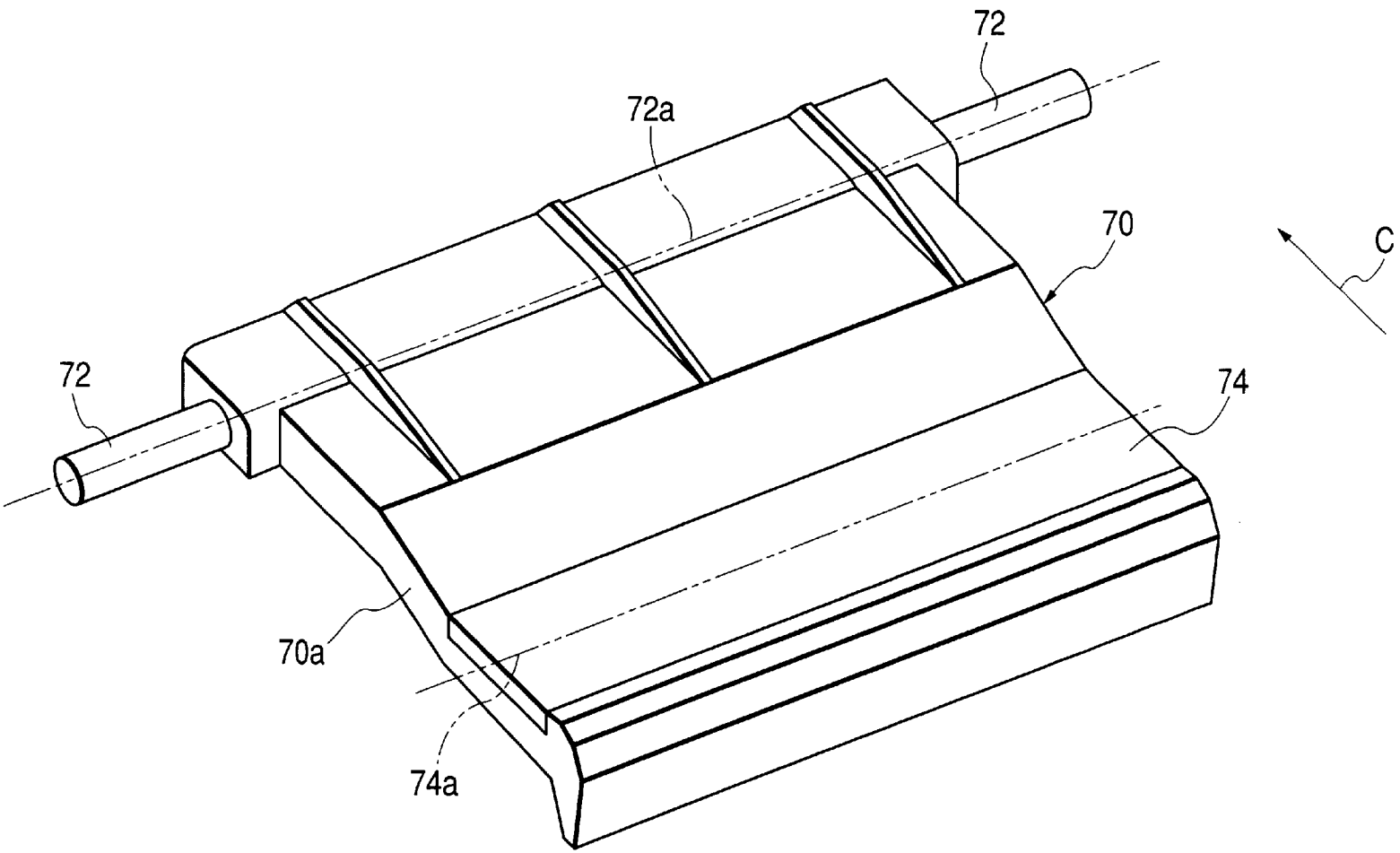
FIG. 7 is a perspective view of a conventional separating pad.
Figure 8:
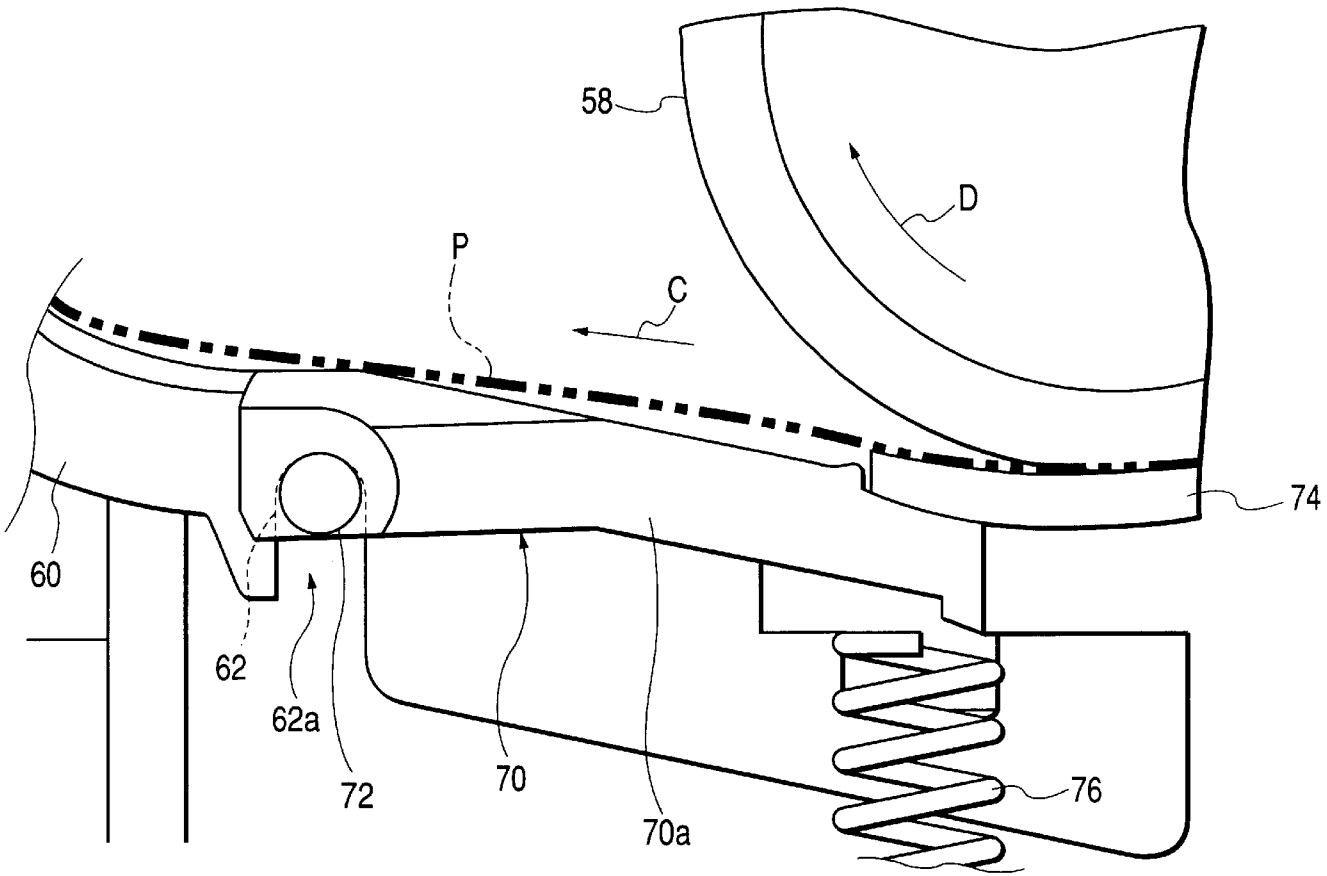
FIG. 8 is an enlarged view of a conventional sheet feeding roller and the conventional separating pad.

Some embodiments of the present invention will hereinafter be described with reference to the accompanying drawings. FIG. 1 is a longitudinal cross-sectional view showing a first embodiment of the sheet feeding apparatus of the present invention, FIG. 2 is a front view of the sheet feeding apparatus of FIG. 1 as viewed in the sheet feeding direction, FIGS. 3A and 3B are enlarged views showing a pivot shaft fitted in a groove, and FIG. 4 is a longitudinal cross-sectional view of an image forming apparatus (printer) on which the sheet feeding apparatus of the present embodiment is mounted. In these figures, the same constituents as the conventional constituents shown in FIGS. 6 to 8 are given the same reference characters.

As example of the printer provided with the sheet feeding apparatus of the present invention will first be described with reference to FIG. 4.

The printer 10 contains therein a laser optical system 14 emitting a laser beam 12 on the basis of image information. The laser beam 12 emitted from the laser optical system 14 is applied to a photosensitive drum 16, whereby an electrostatic latent image is formed thereon. A charger 18 for uniformly charging the surface of the photosensitive drum 16, a developing device 20 for supplying a developer (toner) to the electrostatic latent image to thereby form a developed image, a transferring roller 22 for transferring the developed image to a sheet, etc. are successively disposed around the photosensitive drum 16 along the direction of rotation thereof (the direction indicated by the arrow A).

A fixing device 24 for fixing the developed image on the sheet is disposed in above the photosensitive drum 16. In the fixing device 24, there are disposed a fixing roller 24*a* containing a heater therein, and a pressure roller 24*b* which is in pressure contact with the fixing roller 24*a*. When the transferred image is to be fixed on the sheet, the sheet is nipped between the fixing roller 24*a* and the pressure roller 24*b* and the transferred image is heated at a predetermined fixing temperature and at the same time, is pressurized. By the heating and pressurization, the transferred image is fixed on the sheet.

Below the photosensitive drum 16, a sheet feeding cassette 26 for containing therein sheets by each same size is detachably mounted in the directions indicated by the double-headed arrow B. An intermediate plate 28 on which the sheets are stacked is disposed in the sheet feeding cassette 26. One end portion of the intermediate plate 28 is upwardly biased by a separating spring 30. In the outlet of the sheet feeding cassette 26 (above the separating spring 30), there is disposed a sheet feeding roller 32 for feeding out the sheets contained in the sheet feeding cassette 26.

The sheet fed out by the sheet feeding roller 32 is conveyed toward the photosensitive drum 16 while being guided by a guide roller 34. In FIG. 4, the alternate long and two short dashes line 36 indicates the conveying route of the sheet. Downstream of the guide roller 34 in the conveying direction, there are disposed a set of registration rollers 38 rotated in synchronism with the rotative driving of the photosensitive drum 16, and the registration rollers 38 correct the skew feed of the sheet, and adjust the feed timing of the sheet so as to positionally accord with the developed image formed on the photosensitive drum 16.

When an image is to be formed on the sheet by the printer 10, the laser beam 12 emitted from the laser optical system 14 is applied to the photosensitive drum 16, whereby an electrostatic latent image is formed thereon. The electrostatic latent image is developed by the toner supplied from the developing device 20, whereby a developed image is formed. The developed image moves toward the transferring roller 22 with the rotation of the photosensitive drum 16.

On the other hand, the sheet fed out of the sheet feeding cassette 26 is guided to the registration rollers 38 by the guide roller 34. The sheet is conveyed from the registration rollers 38 toward the transferring roller 22 at a predetermined timing. The thus conveyed sheet is charged to the opposite polarity to the developer forming the developed image and therefore, the developer is attracted to the sheet and a transferred image is formed. The sheet on which the transferred image has been formed is sent into the fixing device 24, whereby the transferred image is fixed on the sheet, whereafter the sheet is discharged onto a sheet discharge tray 42 by sheet discharging rollers 40. Below the laser optical system 14, there is disposed a case 44 containing therein electrical parts such as a power source and a printed substrate, a control device for effecting various kinds of control, a controller board and so on.

A multisheet feeding apparatus 50 is disposed on the front side of the printer 10, and the multisheet feeding apparatus 50 will hereinafter be described with reference to FIGS. 1, 2, 3A and 3B.

Sheets of various sizes or various kinds can be set on the multisheet feeding apparatus 50. The multisheet feeding apparatus 50 is provided with an intermediate plate 54 on which a plurality of sheets P are stacked, and an intermediate plate spring 56 for upwardly biasing the leading edge side end portion of the intermediate plate 54 in the sheet feeding direction. Above the intermediate plate spring 56, there is disposed a sheet feeding roller 58 as the sheet feeding rotary member of the present invention for feeding the sheets stacked on the intermediate plate 54 one by one in the sheet feeding direction (the direction indicated by the arrow C). Also, the multisheet feeding apparatus 50 is provided with a side regulating plate 82 for regulating and jogging the widthwise opposite end portions of the sheets P stacked on the intermediate plate 54.

The construction of a separating pad 70 which is an essential portion of the present invention will now be described in detail. Two pivot shafts 72 are formed on the separating pad holder 70*a* of the separating pad 70 provided in the multisheet feeding apparatus 50. Also, a separating pad member 74 is stuck on the separating pad holder 70*a*. This structure is the same structure as that of the conventional multisheet feeding apparatus 50. Also, a sheet feeding guide 60 is formed of grooves 62 of U-shaped cross-section as the recess of the present invention into which two pivot shafts 72 are fitted.

A feature of the multisheet feeding apparatus 50 of the present invention is that a silicone adhesive 84 which is an elastic adhesive material as the vibration absorbing member of the present invention is interposed in the portion of contact wherein the two pivot shafts 72 are in contact with the inner wall surfaces 63 of the grooves 62. Since the silicone adhesive 84 is thus interposed between the pivot shafts 72 and the inner wall surfaces 63 of the grooves 62, the pivot shafts 72, even if vibrated, do not contact with the inner wall surfaces 63 (except vertexes 63*a*). Also, as shown in FIG. 3A, the silicone adhesive 84 is not interposed between the vertex 63*a* of the inner wall surface 63 and the pivot shaft 72, whereas the silicone adhesive 84 having a thickness 84*a* is interposed between the side 63*b* of the inner wall surface 63 and the pivot shaft 72.

Also, as shown in FIG. 3B, the silicone adhesive 84 is interposed between the inner wall surface 63 and the pivot shaft 72 even at a location whereat the pivot shaft 72 is off the vertex 63*a* of the inner wall surface 63 of the groove 62 and therefore, in whatever state, the space between the inner wall surface 63 and the pivot shaft 72 can be filled with the silicone adhesive 84.

Further, the pivot shaft 72 of the separating pad holder 70*a* is fitted into the U-shaped groove 62 and the separating pad holder 70*a* is biased by the separating spring 76, whereby the separating pad holder 70*a* is moved in the groove 62, and the line of contact 74*a* when the separating pad member 74 contacts with the sheet feeding roller 58 and the center line of pivotal movement 72*a* of the pivot shafts 72 of the separating pad holder 70*a* can be automatically made parallel to each other.

In interposing the silicone adhesive 84 as described above, a liquid silicone adhesive 84 is poured into between the pivot shaft 72 and the inner wall surface 63. When a predetermined time elapses, the silicone adhesive 84 cures and has elasticity. Also, the pivot shaft 72 is biased against the vertex 63*a* of the U-shaped groove 62 by the separating spring 76. Accordingly, the separating pad holder 70*a* is forced into coincidence with the position of the U-shaped groove 62 and therefore, the positional relationship between the separating pad member 74 and the sheet feeding roller 58 is kept proper, and the sheet P is fed smoothly without such a trouble as double feed. Also, the pivot shaft 72 is elastically secured in the interior of the groove 62 by the adhesive and is free to move and therefore, the separating pad holder 70*a* can also be freely pivotally moved about the pivot shaft 72 by the separating spring 76.

Also, by using the silicone adhesive, it is easy to bring the silicone adhesive into between the pivot shaft 72 and the groove 62. Also, the silicone adhesive cures and becomes rubber-like and therefore, after it has cured, it does not protrude and can be easily interposed as a vibration absorbing material.

Here, description will be made of the action of the silicone adhesive 84 when the multisheet feeding apparatus 50 feeds the sheet P in the direction indicated by the arrow C.

The separating pad member 74 is biased against the sheet feeding roller 58 by the separating spring 76. Therefore, the sheets P nipped by and between the separating pad member 74 and the sheet feeding roller 58 are fed one by one in the sheet feeding direction by the sheet feeding roller 58 being rotated in the direction indicated by the arrow D. Here, the coefficient of friction of the sheet feeding roller 58 and the coefficient of friction of the separating pad member 74 with respect to the sheet P differ from each other. Also, in the multisheet feeding apparatus 50, the grooves 62 are larger than the outer diameter of the pivot shafts 72, and the silicone adhesive 84 is interposed between the two.

Accordingly, when the sheet P nipped by and between the separating pad member 74 and the sheet feeding roller 58 is fed, even if the sheet P and the separating pad member 74 rub against each other to thereby cause a stick-slip motion and the separating pad holder 70*a* tends to vibrate in the sheet feeding direction and the direction opposite thereto, the vibration is absorbed by the silicone adhesive 84. Also, depending on the thickness, density and stiffness of the sheet P, a vehement stick-slip motion is caused and the separating pad holder 70*a* tends to vibrate greatly in the sheet feeding direction and the direction opposite thereto. Such vibration, however, is absorbed by the silicone adhesive 84. Thus, even if the separating pad holder 70*a* tends to vibrate, the vibration is suppressed by the silicone adhesive 84 and therefore, the pad chatter can be reliably prevented.

Thus, the use of the elastic adhesive leads to the adhesively securing function of pivotally supporting the separating pad and the vibration absorbing function of absorbing the vibration of the separating pad, and the pad chatter can be prevented by a simple construction.

Figure 5:
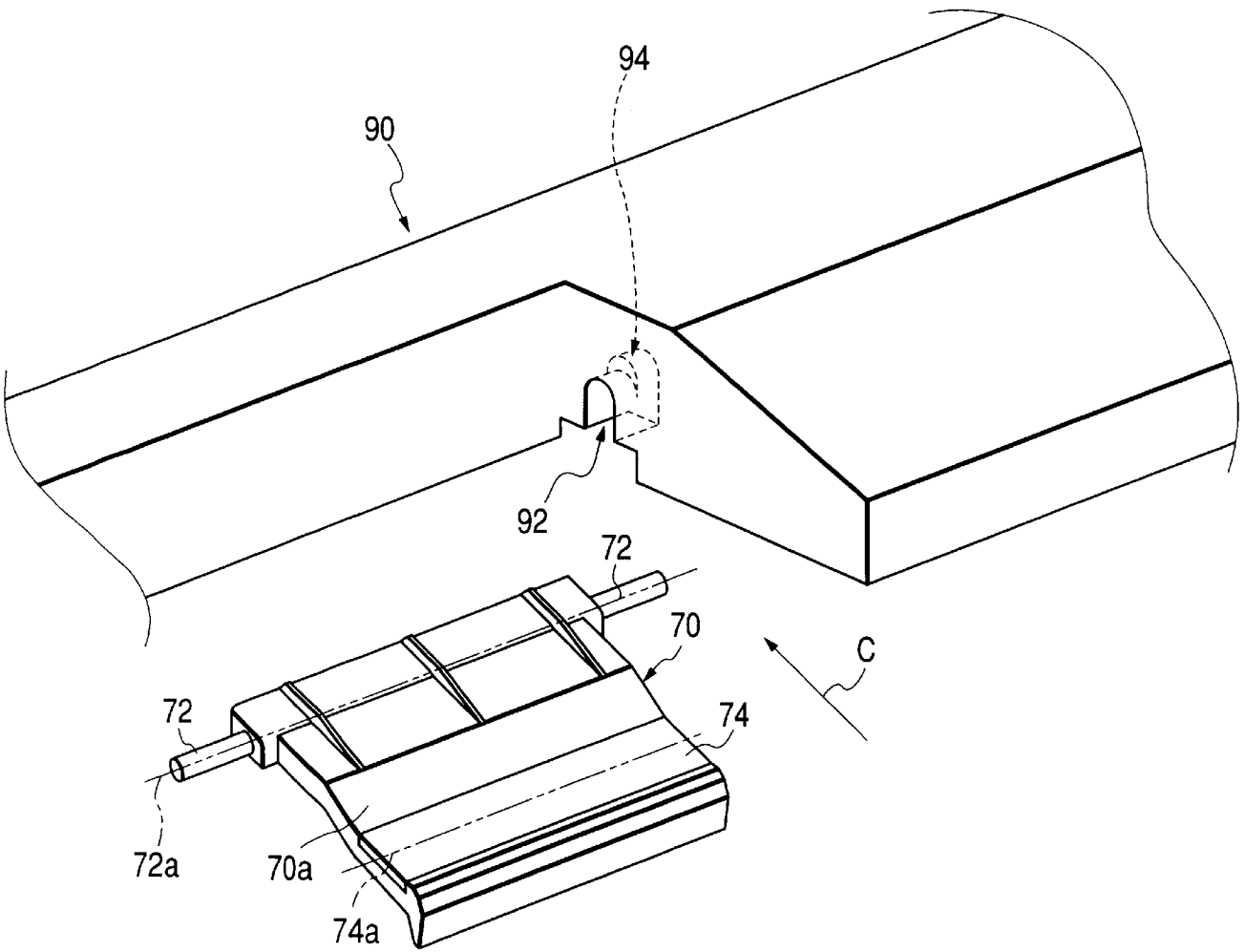
FIG. 5 is an exploded perspective view showing another example of the groove into which the pivot shaft of a separating pad is fitted.

Reference is now had to FIG. 5 to describe another example of the groove into which the pivot shaft 72 is fitted. FIG. 5 is a perspective view showing a sheet feeding guide 90 from which the separating pad holder 70*a* has been detached. In FIG. 5, the same constituents as the constituents shown in FIG. 7 are given the same reference characters.

The shaft feeding guide 90 is formed with a groove 92 into which the pivot shaft 72 is fitted. As in FIG. 3A, a silicone adhesive 84 is interposed between the pivot shaft 72 fitted in the groove 92 and the groove 92. The feature of the sheet feeding guide 90 is that a groove 94 deeper than the groove 92 is formed in the inner side adjacent to the groove 92.

As described above, in interposing the silicone adhesive 84, a liquid silicone adhesive 84 is poured into between the pivot shaft 72 and the inner wall surface 63. If in this case, the quantity of the liquid silicone adhesive 84 is too great, the excess quantity will flow into the groove 94. Accordingly, the silicone adhesive 84 will not leak to the surface (the surface contacted by the sheet P) of the sheet feeding guide 90 and the separating pad 70 side, and bad conveyance and bad separation by the separating pad 70 can be prevented.

The present invention is not restricted to the above-described embodiments, and while in the above-described embodiments, the silicone adhesive has been described as an example of the vibration absorbing member, other elastic adhesive may be used as the vibration absorbing member.

Also, the pivot shaft of the separating pad may be designed to be inserted not into a U-shaped groove but into a circular hole, which may be filled with an elastic adhesive. Also, a groove or a hole may be formed in the separating pad holder side of the separating pad and a pivot shaft may be provided on a member (the sheet feeding guide 60 in the present embodiment) supporting the separating pad, and the separating pad may be fitted onto the pivot shaft so as to pivotally support the separating pad.

Further, while in the present embodiment, description has been made of an example in which the present invention is applied to a sheet feeding apparatus for a recording medium to be supplied to effect image formation, the present invention may also be applied to a sheet feeding apparatus for supporting an original to image reading means, i.e., a so-called auto original feeder.

What is claimed is:

1. A sheet feeding apparatus, comprising:

a sheet feeding rotary member rotatable in a direction for feeding sheets;

a separating pad biased toward said sheet feeding rotary member, wherein the sheets are separated one by one between said sheet feeding rotary member and said separating pad to be fed out; and a vibration absorbing member interposed between said separating pad and a pad supporting portion for pivotally supporting said separating pad for absorbing vibrations of said separating pad.

2. A sheet feeding apparatus according to claim 1, wherein one of said separating pad and said pad supporting portion is provided with a pivot shaft and the other is provided with a recess into which said pivot shaft is fitted, and said pivot shaft is fitted into said recess to thereby pivotally support said separating pad, and said vibration absorbing member is interposed between said pivot shaft and said recess.

3. A sheet feeding apparatus according to claim 1, wherein said vibration absorbing member is an elastic adhesive for adhesively securing said separating pad to said pad supporting in a pivotable state.

4. A sheet feeding apparatus comprising:

a sheet feeding rotary member rotatable in a direction for feeding sheets;

a separating pad biased toward said sheet feeding rotary member, wherein the sheets are separated one by one between said sheet feeding rotary member and said separating pad to be fed out; and an elastic adhesive filling a space between said separating pad and a supporting portion for pivotally supporting said separating pad.

5. A sheet feeding apparatus according to claim 4, wherein said elastic adhesive is a silicone adhesive.

6. A sheet feeding apparatus according to claim 5, wherein said silicone adhesive cures in a state having elasticity with a lapse of time.

7. A sheet feeding apparatus according to claim 4, wherein one of said separating pad and said pad supporting portion is provided with a pivot shaft and the other is provided with a recess into which said pivot shaft is fitted, and said pivot shaft is fitted into said recess to thereby pivotally support said separating pad.

8. A sheet feeding apparatus according to claim 7, wherein said recess is formed with a protrusion preventing groove for preventing said elastic adhesive from protruding.

9. A sheet feeding apparatus according to claim 4, wherein said separating pad is provided with a separating pad holder and a separating pad member stuck on said separating pad holder, said separating pad holder is provided with a pivot shaft orthogonal to the direction for feeding sheets, and said pad supporting portion is provided with a U-shaped groove into which said pivot shaft is fitted, and wherein said sheet feeding apparatus comprises a spring for biasing said separating pad holder to thereby urge said pivot shaft against a vertex side of said groove.

10. An image forming apparatus comprising:

a sheet feeding rotary member rotatable in a direction for feeding sheets;

a separating pad biased toward said sheet feeding rotary member, wherein the sheets are separated one by one between said sheet feeding rotary member and said separating pad to be fed out;

image forming means for forming an image on a fed sheet; and a vibration absorbing member interposed between said separating pad and a pad supporting portion for pivotally supporting said separating pad for absorbing vibrations of said separating pad.

11. An image forming apparatus comprising:

a sheet feeding rotary member rotatable in a direction for feeding sheets;

a separating pad biased toward said sheet feeding rotary member, wherein the sheets are separated one by one between said sheet feeding rotary member and said separating pad to be fed out;

image forming means for forming an image on a fed sheet; and an elastic adhesive filling a space between said separating pad and a pad supporting portion for pivotally supporting said separating pad.

* * * * *

UNITED STATES PATENT AND TRADEMARK OFFICE

CERTIFICATE OF CORRECTION

PATENT NO. : 6,712,350 B2
DATED : March 30, 2004
INVENTOR(S) : Tetsuo Tokuda

It is certified that error appears in the above-identified patent and that said Letters Patent is hereby corrected as shown below:

Column 3,
Line 40, “prevent” should read -- present --.

Column 8,
Line 7, “ing in” should read -- ing portion in --.

Signed and Sealed this

Third Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,712,350 B2
DATED : March 30, 2004
INVENTOR(S) : Tetsuo Tokuda

It is certified that error appears in the above-identified patent and that said Letters Patent is hereby corrected as shown below:

Title page,
Item [30], Foreign Application Priority Data, "Jan. 31, 2002 (JP) ……. 2002-023917" should be deleted.

Signed and Sealed this

Seventh Day of September, 2004

JON W. DUDAS
*Director of the United States Patent and Trademark Office*